United States Patent [19]

Meguerdichian et al.

[11] Patent Number: 4,627,518

[45] Date of Patent: Dec. 9, 1986

[54] BACKUP POSITION SIGNALING IN AN ELEVATOR

[75] Inventors: Gary M. Meguerdichian, Waterbury; Isabel B. Hovey, Bristol, both of Conn.

[73] Assignee: Otis Elevator Company, Farmington, Conn.

[21] Appl. No.: 727,313

[22] Filed: Apr. 25, 1985

[51] Int. Cl.[4] ..... B66B 3/02

[52] U.S. Cl. ..... 187/29 R; 340/21

[58] Field of Search ..... 187/29 R; 390/19, 21

[56] References Cited

U.S. PATENT DOCUMENTS 4,124,103 11/1978 Otto et al. ..... 187/29 R 4,142,609 3/1979 Tachino ..... 187/29 R 4,368,518 1/1983 Terazono et al. ..... 187/29 R X

*Primary Examiner*—William M. Shoop, Jr.

*Assistant Examiner*—W. E. Duncanson, Jr.

[57] ABSTRACT

An elevator has a car position transducer that provides an output signal indicating car location. A car controller causes that signal to be stored in a memory. The controller compares the stored signal with a current transducer output and stores the current signal when the difference between the two exceeds a preset amount. A detector senses the elevator system power level and connects a backup power supply to the memory and the transducer when there is a power loss. A car motion detector senses the transducer output and removes the backup power from the transducer when the car stops moving.

3 Claims, 3 Drawing Figures

BACKUP POSITION SIGNALING IN AN ELEVATOR

DESCRIPTION

1. Technical Field

This invention relates to techniques for determining car position in a computer-controlled elevator following a power failure.

2. Background Art

In a computer-controlled elevator that does not have an absolute car position sensor or encoder, sometimes known as the primary position transducer or PPT, the car position is stored in a separate memory that is controlled by the computer, and in the event of a power failure, the car's current position, which is stored in this memory, is irretrievably lost. Once power is restored in an elevator using a nonabsolute position transducer, the car must be moved some short distance to load its current position into the memory. In elevators in which the more expensive absolute PPT is used such car movement is not necessarily required after a power failure.

DISCLOSURE OF INVENTION

Among the objects of this invention is providing, in an elevator with a nonabsolute PPT, a technique by which car position is accurately known immediately after a power failure that inactivates the main control system.

According to the invention, a separate position memory receives car position information from the PPT. When a power failure is detected, the output from the position sensor is stored once the car has stopped moving. This stored position is maintained with a backup power supply until the power is restored, and at that time the stored position is read by the system computer.

According to one aspect of the invention, the position sensor (PPT) is separately powered until the point at which the car stops moving; then the power is removed. This minimizes the power consumption from the backup power supply during the power failure.

According to another aspect, the stored car position is checked during normal operation to determine if it is within a preestablished range of the actual car position represented by the PPT output. If it is not, the stored position is updated to the correct position.

BEST MODE FOR CARRYING OUT THE INVENTION

Figure 1:
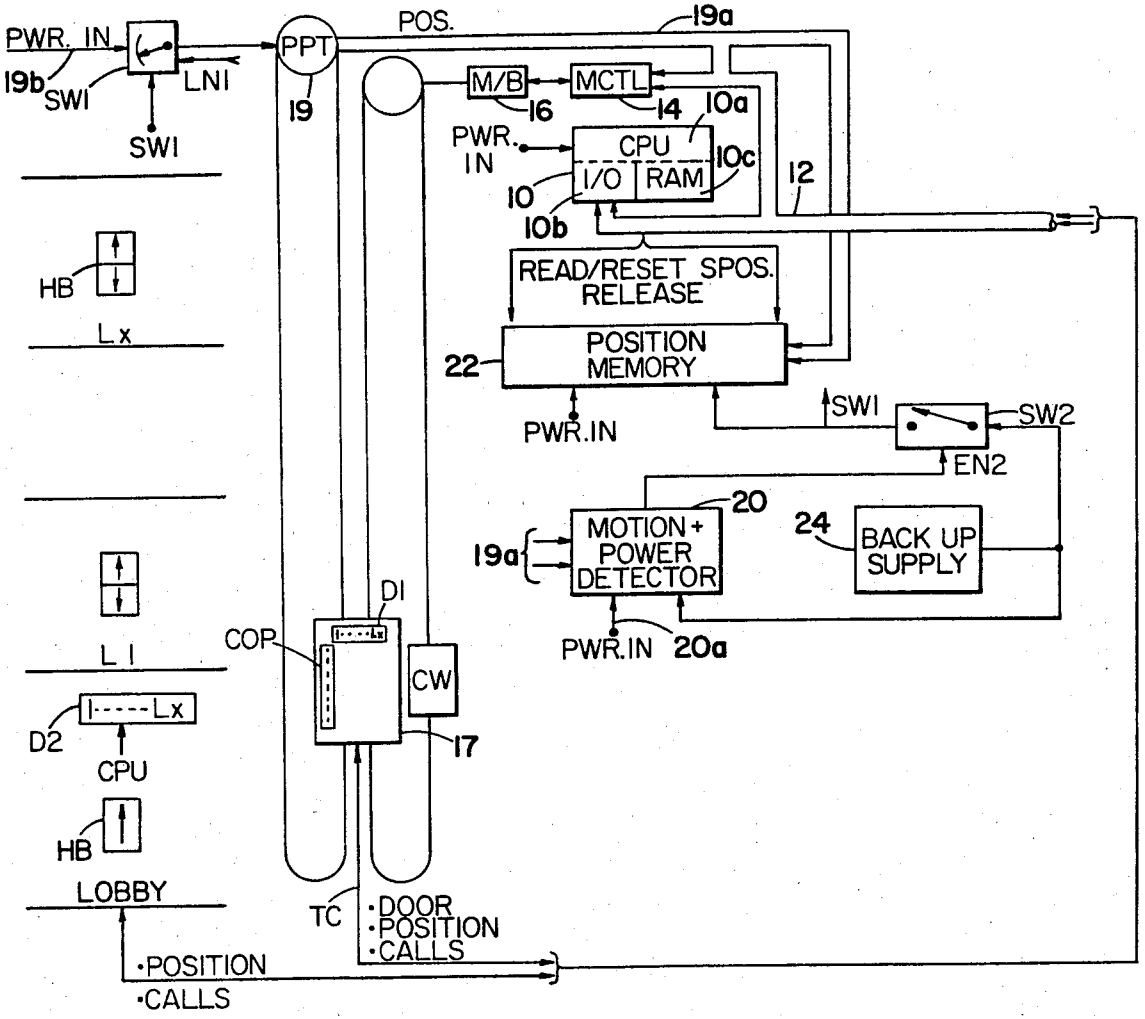
FIG. 1 is a functional block diagram of an elevator system embodying the invention.

FIG. 1 shows a simplex (one car) traction elevator embodying the invention, but the invention may be used in a traction, hydraulic, or other type of elevator system containing more than one car. The invention is targeted at maintaining position information irrespective of the type of system in which it is used.

A computer-controlled car controller 10 provides control signals over a line 12 to a motor controller (MCTL) 14 which controls the operation of a drive 16 comprising an electric motor (M) and a brake (B), which are not shown in any detail. The motor in the drive propels an elevator car 17 between a plurality of landings from the LOBBY, through L1–LX. On each landing and in the LOBBY there are hall buttons (HB) for registering hall calls. A counterweight CW is connected to the car. The car contains a car operating panel COP, on which car calls are entered. Information is relayed between the car and the controller on a traveling cable TC. A position indicator D1 is located in the car and shows the car position in response to a position signal from the controller. In the LOBBY there is another car position indicator D2.

A quasi-absolute primary position transducer (PPT) 19 is also connected to the car and rotates as the car is propelled along in the elevator shaft, producing an output signal (POS. signal) which reflects the current position of the car. The POS. signal is supplied on the line 19A to a motion and power detector 20 and a position memory 22. A backup battery power supply 24 provides "backup" power (BPWR) to the motion and power detector, and, through two switches SW1 and SW2, to the PPT and the position memory. The motion and power detector senses the system power state (PWR IN) on a line **20*a* and, when the power disappears (e.g., a low voltage is detected) operates the switches with the EN1 and EN2 enable signals. This connects the BPWR to the PPT and the position memory. The controller, which is simplistically shown as having a processor (CPU) 10A, input/output ports and memory (I/O) 10B, and (RAM) 10C, receives the POS. signal, and uses it for normal elevator operation; that is, until a power failure takes place. At that time the computer shuts down. When this occurs, the motion and power detector connects the BPWR to the PPT, which normally operates on the system power (PWR IN) on the line 19*b*** through the switch SW1. During continued car motion, the POS. signal continues to be generated, and because the motion and power detector are also powered by the BPWR, the position memory continues to update the current car position with the most current POS. signal generated.

At some point, the motion and power detector senses that the car has stopped—that there is no change in the POS. signal. It then removes the EN1 signal. This terminates the battery power to the PPT. Hence, the only battery consumption thereafter is the power supplied to the motion and power detector and position memory units. This is minimal. The POS. signal retained in the position memory at this time is stored as a signal (SPOS. signal) manifesting the car position. This signal is retrieved by the controller once power is restored, and, at that time, the position memory is reinitialized, preferably by using the sequence illustrated in the flowchart comprising FIG. 3. Normally, the position memory only stores the PPT output in response to control signals (e.g., READ) from the controller generated to carry out the sequence in FIG. 3. During a power loss, however, the position can respond directly to the PPT output by applying a READ signal continuously.

After this sequence is entered, at S1, the CPU position memory (e.g., the RAM) is initialized at S2. Then a test is made, at S3, to determine if there was a power loss. If the answer there was yes, the position memory is read at S4, retrieving the SPOS. signal from the position memory, that signal being the car position after it stopped during the power failure. Then the actual position is calculated at S5 using the SPOS. signal and displayed on displays D1 and D2 in the step S6. If there was no power failure, the test is whether the car is ready to move, and this is done in step S7. On a negative answer, the initialization routine ended (EXIT) in step S8. A positive answer leads to an initialization procedure for the position memory that starts at step S9, which asks if the SPOS. signal is within an acceptable range (X) of the POS. signal. If it is not, the position memory is updated to contain an SPOS. signal, meeting the test, at step S10. In this manner, the SPOS. signal in the position memory is always within the tolerance allowances by "X", which defines a course range. The sequence then ends at step S11.

Figure 3:
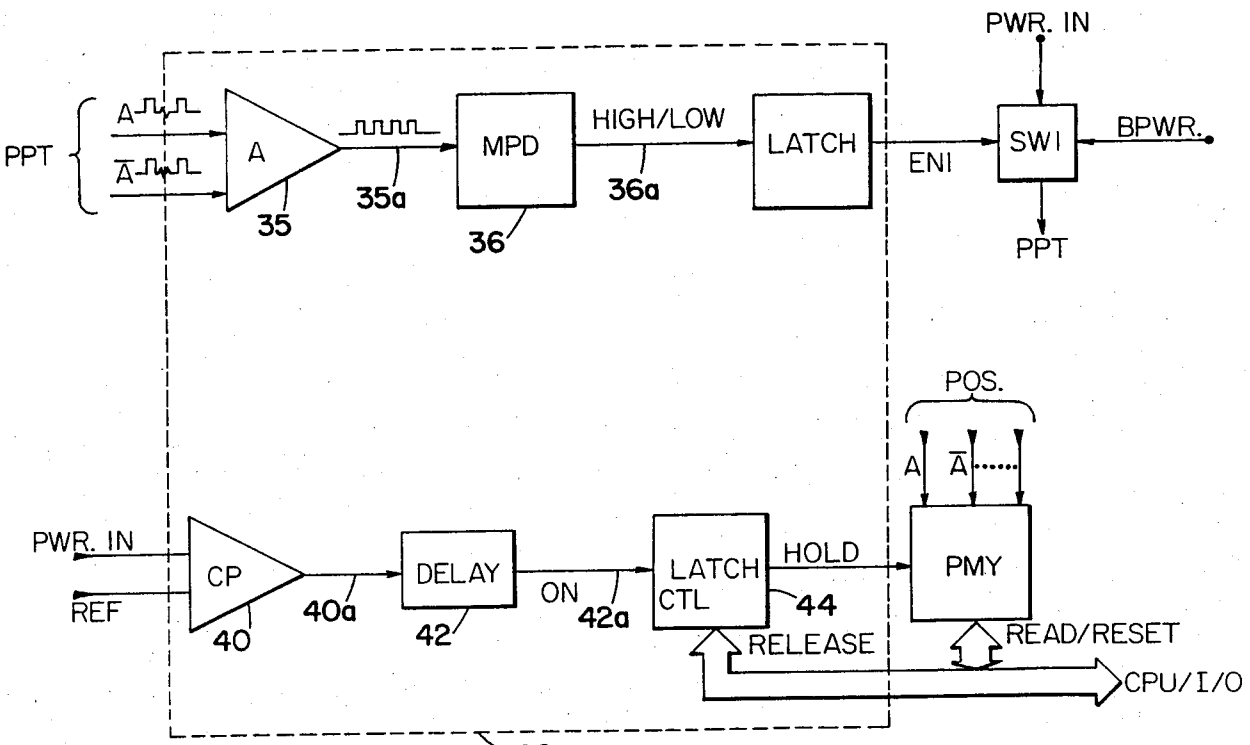
FIG. 3 is a functional block diagram showing a motion detector and position logic circuit and position memory, which may be used in the system shown in FIG. 1.

FIG. 3 shows the motion detector and position logic unit in greater detail. In this case, the sensed PPT output includes two inputs, each capable of being at a binary one or zero level, from which a change in position (course) can be noticed. U.S. Pat. No. 4,384,275 to Masel et al shows a PPT that provides a "two-bit" output A, $\overline{A}$ suitable for this purpose. These states change as the car moves, manifesting a change between four course positions. These signals are supplied to an amplifier 35 that combines them into a single output on line 35*a* that is supplied to a missing pulse detector (MPD) 36, a known device, that provides an output signal, which may be high/low, on the line 36*a* when there is not level change on the line 35*a*. That output signal on the line 36*a* activates a latch that provides the EN1 enable signal to the switch SW1, connecting the backup power (BPWR) to the PPT. The EN1 signal is removed from the switch SW1, and the power is removed from the PPT, when the PPT output is static, which happens when the car is stationary.

Figure 2:
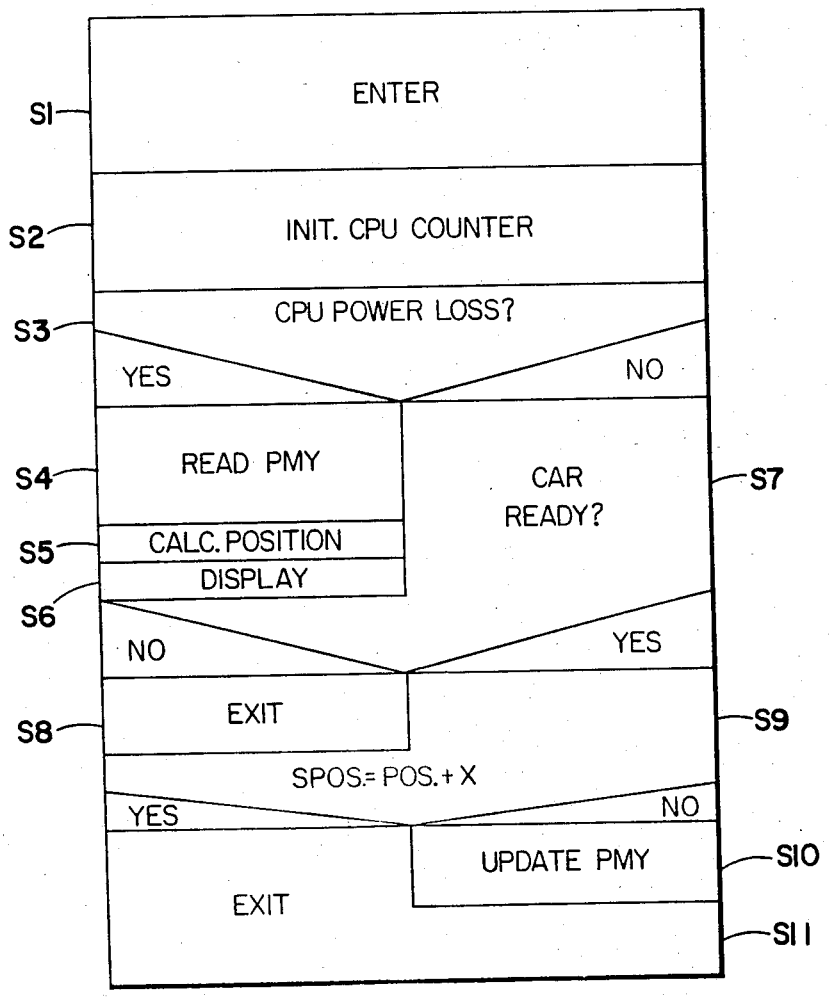
FIG. 2 is a flowchart showing a routine which may be carried out by a computer, in any form, to use the invention in an elevator.

The input power (PWR IN) is supplied to one side of a comparator (CP) 40. A reference (REF) is supplied to the other side. When the PWR IN disappears (in a power failure), the comparator 40 activates a delay 42, to produce an output change on the line 42*a* only if the comparator output is still high after a preset time delay. The ON signal activates another latch 44 that provides a HOLD signal to cause the position memory (PMY) to hold the current PPT output (the POS. signal). The latch and the position memory are connected to the data bus that connects with the car controller, which provides a RELEASE signal to release the latch, a READ signal to read the PMY, and a RESET signal to reset or initialize the PMY in the initialization sequence shown in FIG. 2.

In a group of elevators there can be a separate position memory for each car controlled by a common motion and power detector, and each car's PPT can be powered from a common backup power supply through individual switches controlled by the motion and power detector.

Furthermore, one skilled in the art may make other modifications and variations to the invention explained herein without departing from the true scope and spirit of the invention.

We claim:

1. An elevator comprising a car, a car controller, and position transducer connected to a car for providing distinct car position signals, a source of system power, the elevator being characterized by:

position memory means for storing position signals from the transducer therefrom for retrieval by the controller after the controller is shut down and restarted;

a backup power supply;

first switch means for connecting the supply to the position memory means in response to a first control signal;

second switch means for connecting the power supply to the position sensor in response to a second control signal;

logic means for receiving a car position signal from the position transducer for sensing system power level and providing said first and second control signals when the level decreases below a reference level.

2. An elevator according to claim 1 characterized in that:

said logic means comprises means for removing the second control signal when the signal from the car position transducer indicates that the car has stopped moving.

3. An elevator according to claims 1 or 2 further characterized in that:

the controller comprises means for comparing a first position signal stored in the position memory with the current output signal from the position transducer and storing the signal in place of the first position signal if the difference between the two exceeds a predetermined level.

* * * * *